US007571941B2

(12) United States Patent
Chang

(10) Patent No.: US 7,571,941 B2
(45) Date of Patent: Aug. 11, 2009

(54) DOOR LOCK WITH ADJUSTABLE MOUNTING POSTS

(75) Inventor: Hsuan-Cheng Chang, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 0 days.

(21) Appl. No.: 11/938,854

(22) Filed: Nov. 13, 2007

(65) Prior Publication Data

US 2009/0121498 A1 May 14, 2009

(51) Int. Cl.
*E05B 1/00* (2006.01)
*E05B 15/02* (2006.01)

(52) U.S. Cl. ..... 292/347; 292/357; 292/DIG. 60; 70/224

(58) Field of Classification Search ..... 292/347, 292/357, DIG. 60; 70/224
See application file for complete search history.

(56) References Cited

U.S. PATENT DOCUMENTS 2,805,880 A * 9/1957 Brozek et al. ..... 292/357
2,967,728 A * 1/1961 Falk ..... 292/347
3,228,218 A * 1/1966 Wilson ..... 70/475
3,471,190 A * 10/1969 Turnbull et al. ..... 292/356
4,432,576 A * 2/1984 Wartian ..... 292/357
4,930,822 A * 6/1990 Shen ..... 292/357
5,409,278 A * 4/1995 Harcourt ..... 292/357
5,762,387 A * 6/1998 Edgerly et al. ..... 292/357
6,425,613 B1 * 7/2002 Shen ..... 292/348
6,598,440 B1 * 7/2003 Armstrong ..... 70/472
6,619,710 B1 * 9/2003 Hwang ..... 292/336.3
6,745,602 B2 * 6/2004 Nakasone et al. ..... 70/224
6,893,059 B2 * 5/2005 Shen ..... 292/169
7,066,507 B2 * 6/2006 Don ..... 292/336.3
7,207,608 B2 * 4/2007 Monts de Oca ..... 292/341.18

* cited by examiner

*Primary Examiner*—Carlos Lugo
(74) *Attorney, Agent, or Firm*—Alan Kamrath; Kamrath & Associates PA

(57) ABSTRACT

A door lock includes a casing mounted in a bare of a door. The casing includes inner and outer coupling seats to which inner and outer mounting plates are mounted respectively. The outer coupling plate includes two diametrically opposed slots located outside the bore of the door. The inner mounting plate includes a plurality of pairs of diametrically opposed holes. The inner mounting plate is rotatable relative to the inner coupling seat to a position in which one of the plurality of pairs of holes is aligned with the slots. Two mounting posts are extended through the slots and through two through-holes in the door. Each mounting post is slideably received in one of the slots, allowing the mounting posts to move toward or away from each other until a spacing between the mounting posts is equal to that between the two through-holes of the door.

11 Claims, 6 Drawing Sheets

DOOR LOCK WITH ADJUSTABLE MOUNTING POSTS

BACKGROUND OF THE INVENTION

The present invention relates to a door lock and, more particularly, to a door lock with two adjustable mounting posts.

A door lock of the type having two mounting posts generally includes a casing having an inner coupling seat and an outer coupling seat. An inner mounting plate is mounted on the inner coupling seat and includes two diametrically disposed mounting holes. An outer mounting plate is mounted on the outer coupling seat. Two mounting posts are secured to the outer mounting plate and extended through two through-holes in a door to which the door lock is mounted. Two screws are extended through the mounting holes in the inner mounting plate and into screw holes in the mounting posts to fix the inner and outer mounting plates to two sides of the door. The spacing between the axes of the mounting posts is either 65 mm or 70 mm. If the spacing between the centers of the through-holes in the door is not the same as that between the axes of the mounting posts, an installer has to drill another two through-holes in the door for receiving the mounting posts. The drilling operation is difficult and time-consuming due to precision requirements and due to overlapping of the new through-holes with the old ones. Enlargement of the new through-holes by a file or the like is often required due to imprecise location of the new through-holes, leading to the risk of poor coupling of the door lock with the door.

A need exists in a door lock with adjustable mounting posts to eliminate the troublesome formation of new through-holes in the door during installation of a door lock.

BRIEF SUMMARY OF THE INVENTION

The present invention solves this need and other problems in the field of door locks by providing, in a preferred form, a door lock including a casing adapted to be mounted in a bore extending from an inner side through an outer side of a door. The casing includes an outer coupling seat and an inner coupling seat coupled with the outer coupling seat. An outer mounting plate is mounted on the outer coupling seat and adapted to abut with the outer side of the door. The outer coupling plate includes two diametrically opposed slots adapted to be located outside the bore of the door. An inner mounting plate is mounted to the inner coupling seat and adapted to abut with the inner side of the door. The inner mounting plate includes a plurality of pairs of diametrically opposed holes. The inner mounting plate is rotatable relative to the inner coupling seat to a position in which one of the plurality of pairs of holes is aligned with the slots. Two mounting posts are extended through the two slots and adapted to extend through two through-holes in the door. Each mounting post includes a screw hole in an end thereof. Each mounting post further includes a coupling section slideably received in one of the slots of the outer mounting plate, allowing the mounting posts to move in a radial direction toward or away from each other until a spacing between the mounting posts is equal to that between the two through-holes of the door. Two screws are extended through one of the plurality of pairs of holes aligned with the screw holes and into the screw holes of the mounting posts.

In the most preferred form, each slot of the outer mounting plate has a length in the radial direction greater than a diameter of each through-hole of the door. Also, each hole of the inner mounting plate has a length in the radial direction greater than a diameter of each through-hole of the door. Each slot of the outer mounting plate has an inner end, an outer end more distant to the outer coupling seat than the inner end in the radial direction, and two parallel, rectilinear sides extending between the inner and outer ends. The coupling section of each mounting post includes two lateral sides slideably abutting the sides of one of the slots, allowing movement of each mounting post in the radial direction relative to the outer mounting plate and preventing rotational movement of each mounting post relative to the outer mounting plate. The outer end of each mounting post includes an outer flange having a diameter greater than a width of each slot perpendicular to the radial direction. A resilient washer is mounted between and frictionally abuts with the outer flange of each mounting post and an outer side of the outer mounting plate, preventing each mounting post from undesirably moving in the radial direction but allowing forcible movement of each mounting post in the radial direction. The coupling section of each mounting post further includes an inner flange having a diameter greater than the width of each slot. The inner and outer flanges of each mounting post are located on opposite sides of the outer mounting plate to prevent disengagement of each mounting post.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
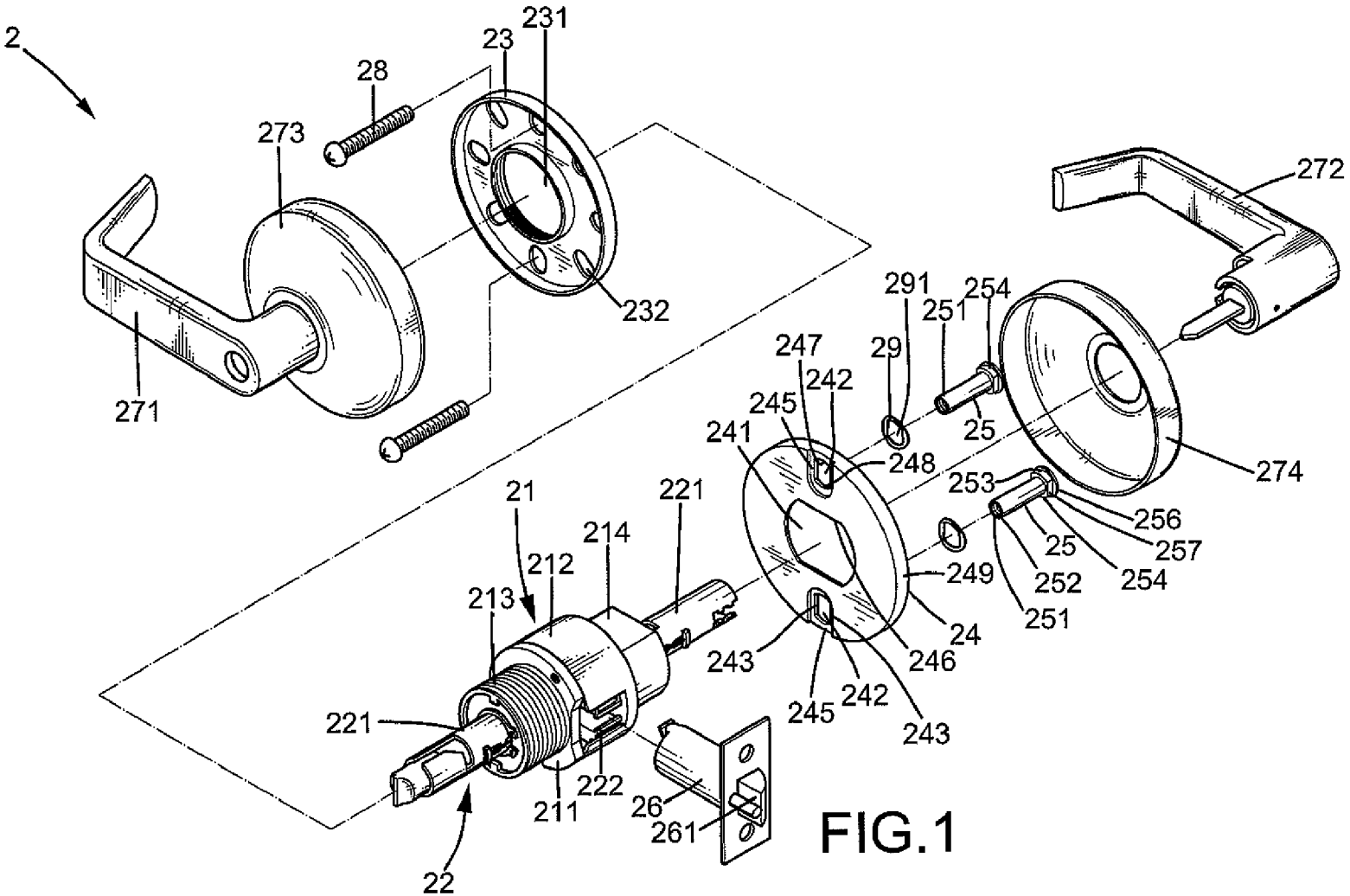
FIG. 1 shows an exploded, perspective view of a door lock according to the preferred teachings of the present invention.
Figure 2:
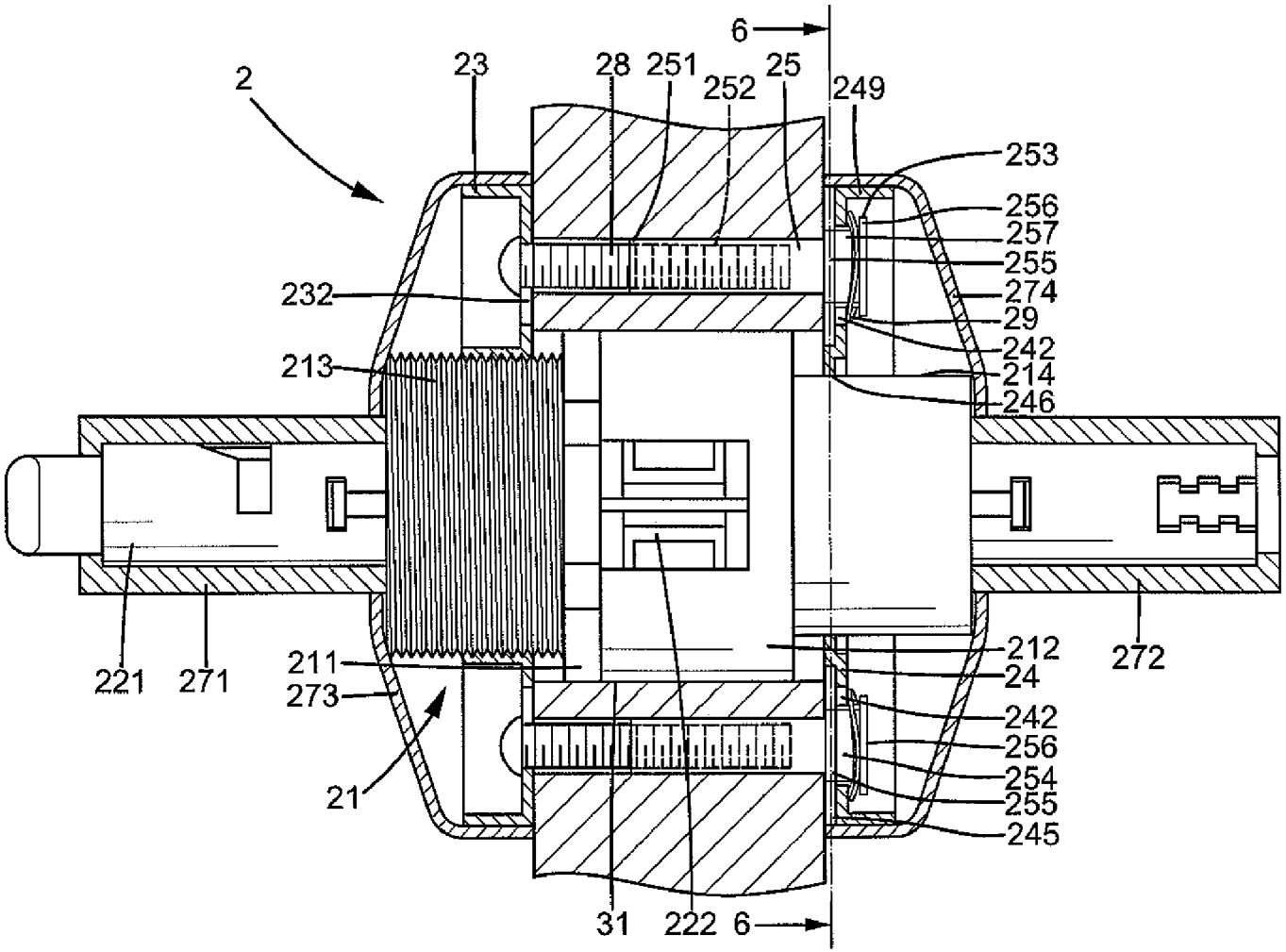
FIG. 2 shows a cross sectional view of the door lock of FIG. 1 and a door to which the door lock of FIG. 1 is mounted.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "end", "section", "periphery", "longitudinal", "radial", "circumferential", "lateral", "annular", "outward", "inward", "spacing", "length", "diameter", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A door lock according to the preferred teachings of the present invention is shown in the drawings and generally designated 2. In the preferred form shown, the door lock 2 includes a casing 21 mounted in a bore 31 extending from an inner side through an outer side of a door 3. The casing 21 includes an inner coupling seat 211 and an outer coupling seat 212 coupled with the inner coupling seat 211. In the most preferred form shown, the inner coupling seat 211 includes outer threading 213, and the outer coupling seat 212 includes two diametrically opposed flat faces 214. A transmission mechanism 22 is received in the casing 21 and includes a spindle 221 and a retractor 222 operably connected to the spindle 221. Inner and outer handles 271 and 272 are respectively mounted to inner and outer ends of the spindle 221 for manual operation. The retractor 222 is connected to a latch 261 of a latch mechanism 26. When either handle 271, 272 is turned, the spindle 221 is rotated to move the retractor 222 which in turn retracts the latch 261 for unlatching purposes.

According to the preferred form shown, an outer mounting plate 24 is mounted to the outer coupling seat 212. In the. most preferred form shown, the outer mounting plate 24 is in the form of a disc having a mounting hole 241 conforming to the shape of the outer coupling seat 212 to prevent rotational movement of the outer coupling seat 212 but allowing movement of the outer mounting plate 24 on the outer coupling seat 212 in a longitudinal direction of the casing 21. Specifically, the mounting hole 241 includes two parallel, rectilinear sides 246 abutting with the flat faces 214 of the outer coupling seat 212. An annular wall 249 extends outward from a periphery of the disc and defines a compartment. The disc further includes two diametrically opposed recessed portions 245 in an inner side thereof. Furthermore, the disc includes two diametrically opposed slots 242 extending from the inner side through an outer side of the disc and respectively extending through bottom walls of the recessed, portions 245. Each slot 242 includes substantially elliptic cross sections. Furthermore, each slot 242 includes an inner end 248 adjacent to the mounting hole 241, an outer end 247 distant to the mounting hole 241, and two parallel, rectilinear sides 243 extending between the inner and outer ends 248 and 247.

According to the preferred form shown, an inner mounting plate 23 is mounted to the inner coupling seat 211. In the most preferred form shown, the inner mounting plate 23 includes a central, threaded hole 231 threadedly engaged with the outer threading 213 of the inner coupling seat 211. Thus, the inner mounting plate 23 can be moved to a desired longitudinal position on the inner coupling seat 211 by turning the inner mounting plate 23. The inner mounting plate 23 further includes four pairs of diametrically opposed and annularly spaced holes 232. Each hole 232 includes substantially elliptic cross sections. One of the four pairs of holes 232 is aligned with the slots 242 of the outer mounting plate 24.

According to the preferred form shown, the door lock 2 further includes two mounting posts 25 extending through the slots 242 of the outer mounting plate 24 and two screws 28. Each mounting post 25 includes an inner end 251 having a screw hole 252 for receiving one of the screws 28 and an outer end 253. In the most preferred form shown, the outer end 253 of each mounting post 25 includes a coupling section 254 engaged in one of the slots 242 of the outer mounting plate 241 and an outer flange 256 having a diameter greater than a width of the slot 242 perpendicular to the radial direction. The coupling section 254 of each mounting post 25 extends radially outward from the outer end 253 and includes two parallel, lateral sides 257. A distance between the lateral sides 257 of the coupling section 254 of each mounting post 25 is equal to that between the sides 243 of one of the slots 242 of the outer mounting plate 24. The lateral sides 257 of the coupling section 254 of each mounting post 25 slideably abut with the sides 243 of one of the slots 242, preventing relative rotational movement between the mounting posts 25 and the outer mounting plate 24 but allowing radial sliding movement of the mounting posts 25 relative to the outer mounting plate 24. Thus, a spacing between two axes respectively of the mounting posts 25 can be adjusted by moving the mounting posts 25 between the inner and outer ends 248 and 247 of the slots 242 in the radial direction. The coupling section 254 of each mounting post 25 is punched to form an inner flange 255 after the coupling section 254 is extended through one of the slots 242. The inner flange 255 has a diameter greater than the width of the slot 242 perpendicular to the radial direction. It is noted that the mounting posts 25 shown in FIG. 1 still do not have inner flanges 255. The inner and outer flanges 255 and 256 prevent the mounting posts 25 from disengaging from the outer mounting plate 24 but allow sliding movement of the mounting posts 25 in the radial direction. It can be appreciated that the inner flanges 255 are received in the recessed portions 245 so that the inner flanges 255 are not in contact with the outer side of the door 3 when the outer mounting plate 24 abuts with the outer side of the door 3 after installation. A resilient washer 29 is mounted between the outer flange 256 of each mounting post 25 and the outer side of the disc. In the most preferred form shown, the resilient washer 29 is arcuate and includes a through-hole 291 through which one of the mounting posts 25 extends. The resilient washer 29 can be deformed to be in frictional contact with the outer flange 256 and the outer side of the disc to prevent undesired movement of the mounting post 25. The through-hole 291 of the washer 29 has elliptic cross sections the same as the slots 242. However, each mounting post 25 can be forcibly moved in the radial direction when applied with a larger force sufficient to overcome the friction.

Figures 3, 4:
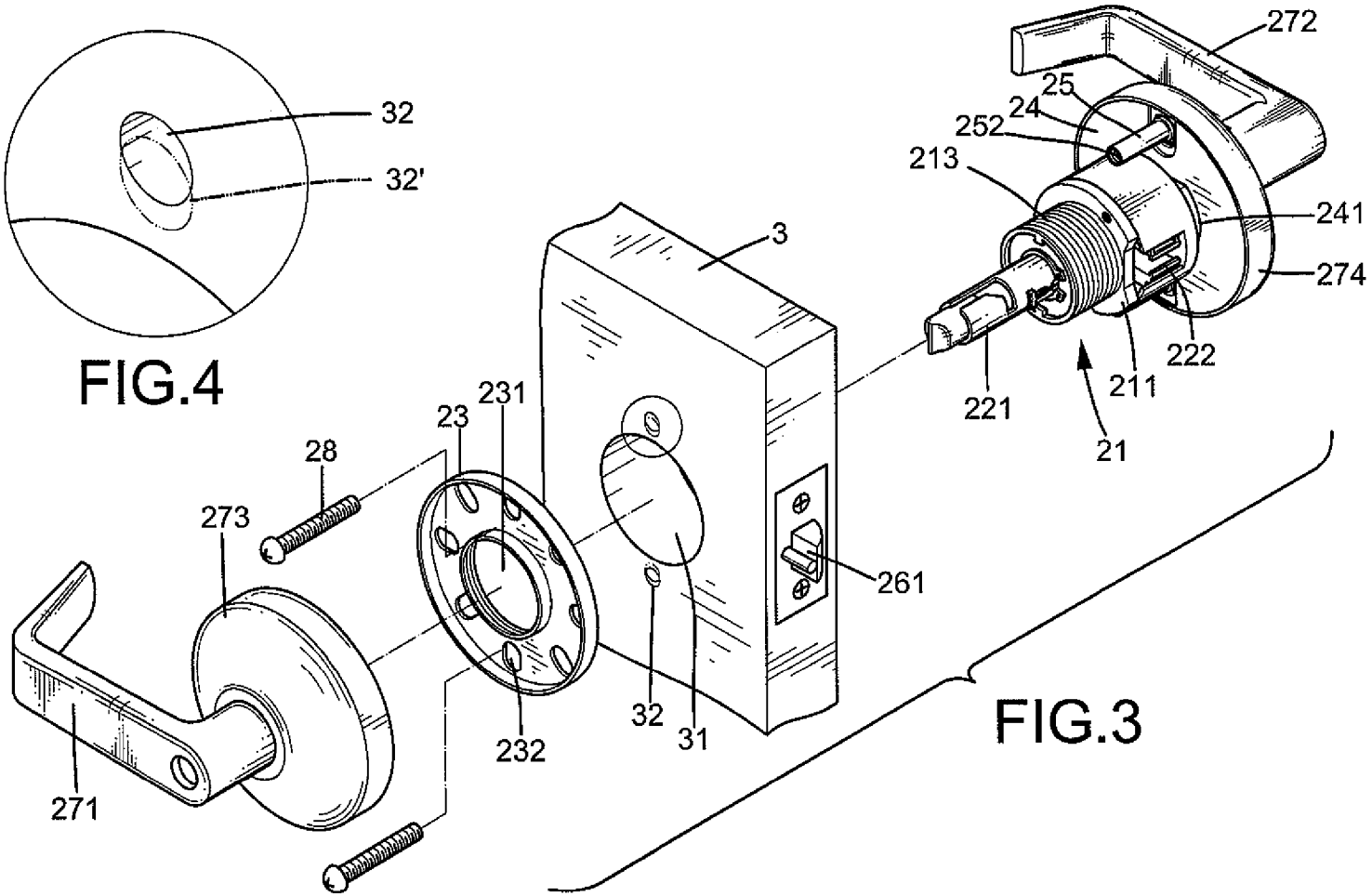
FIG. 3 shows a partially exploded, perspective view of the door lock of FIG. 1 and a partial, perspective view of the door of FIG. 2.
FIG. 4 shows an enlarged view of a circled portion in FIG. 3.
Figure 5:
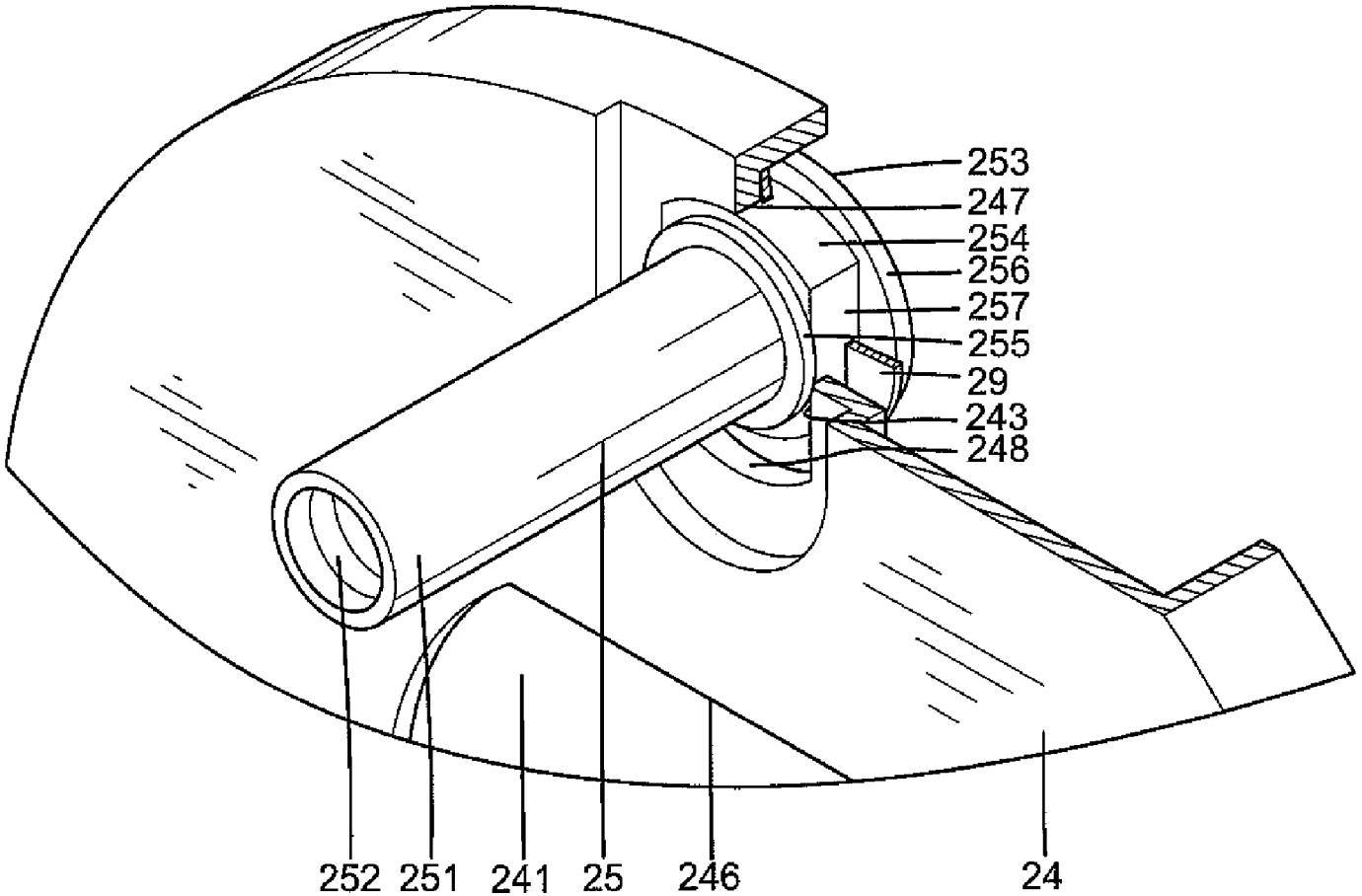
FIG. 5 shows a partial, partly-cutaway, perspective view of the door lock of FIG. 1.
Figure 6:
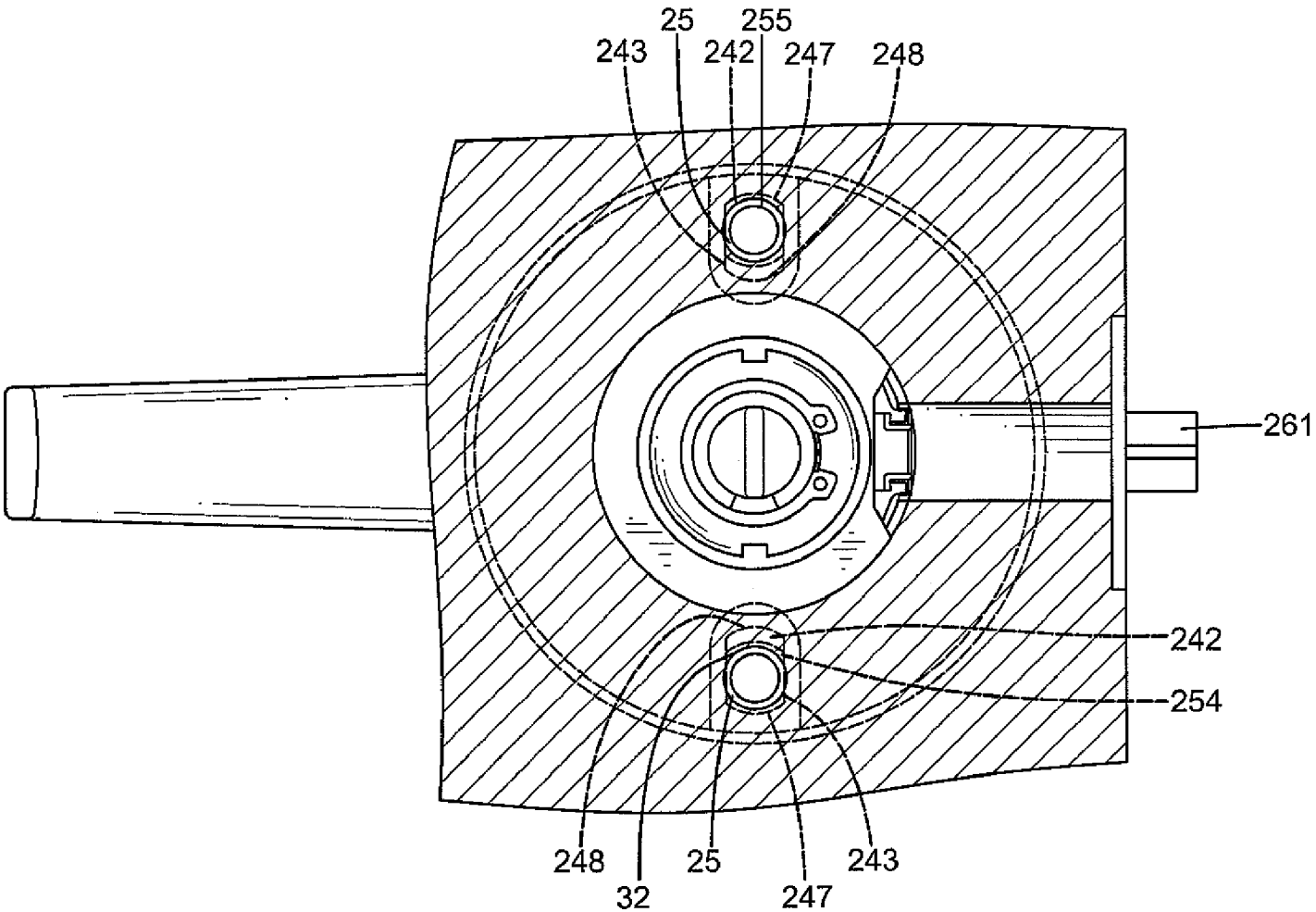
FIG. 6 shows a cross sectional view of the door and the door lock of FIG. 2 according to section line 6-6 of FIG. 2 with two mounting posts having a larger spacing therebetween.

When installing the door lock 2 according to the preferred teachings of the present invention to a door 3 having two through-holes 32 (FIGS. 3 and 4) with a longer spacing therebetween, the mounting posts 25 are moved radially outward to the outer ends 247 of the slots 242 of the outer mounting plate 24. The outer handle 272 is attached to the outer end of the spindle 221, and an outer rose 274 is attached to cover the outer mounting plate 24 and the outer coupling seat 212. It can be appreciated that the outer ends 253 of the mounting posts 25 are received in the compartment of the outer mounting plate 24. The mounting posts 25 are then extended through the through-holes 32 of the door 3. The inner coupling plate 23 is then mounted on the inner coupling seat 211 of the casing 21 and rotated until one of the four pairs of holes 232 of the inner mounting plate 23 is aligned with the screw holes 252 of the mounting posts 25. Next, the screws 28 are extended through the pair of holes 232 of the inner mounting plate 23 aligned with the screw holes 252 and into the screw holes 252 of the mounting posts 25. The inner and outer mounting plates 23 and 24 are secured to and abut with the inner and outer sides of the door 3. The inner handle 271 is attached to the inner end of the spindle 221, and an inner rose 273 is attached to cover the inner mounting plate 23 and the inner coupling seat 211.

Figure 7:
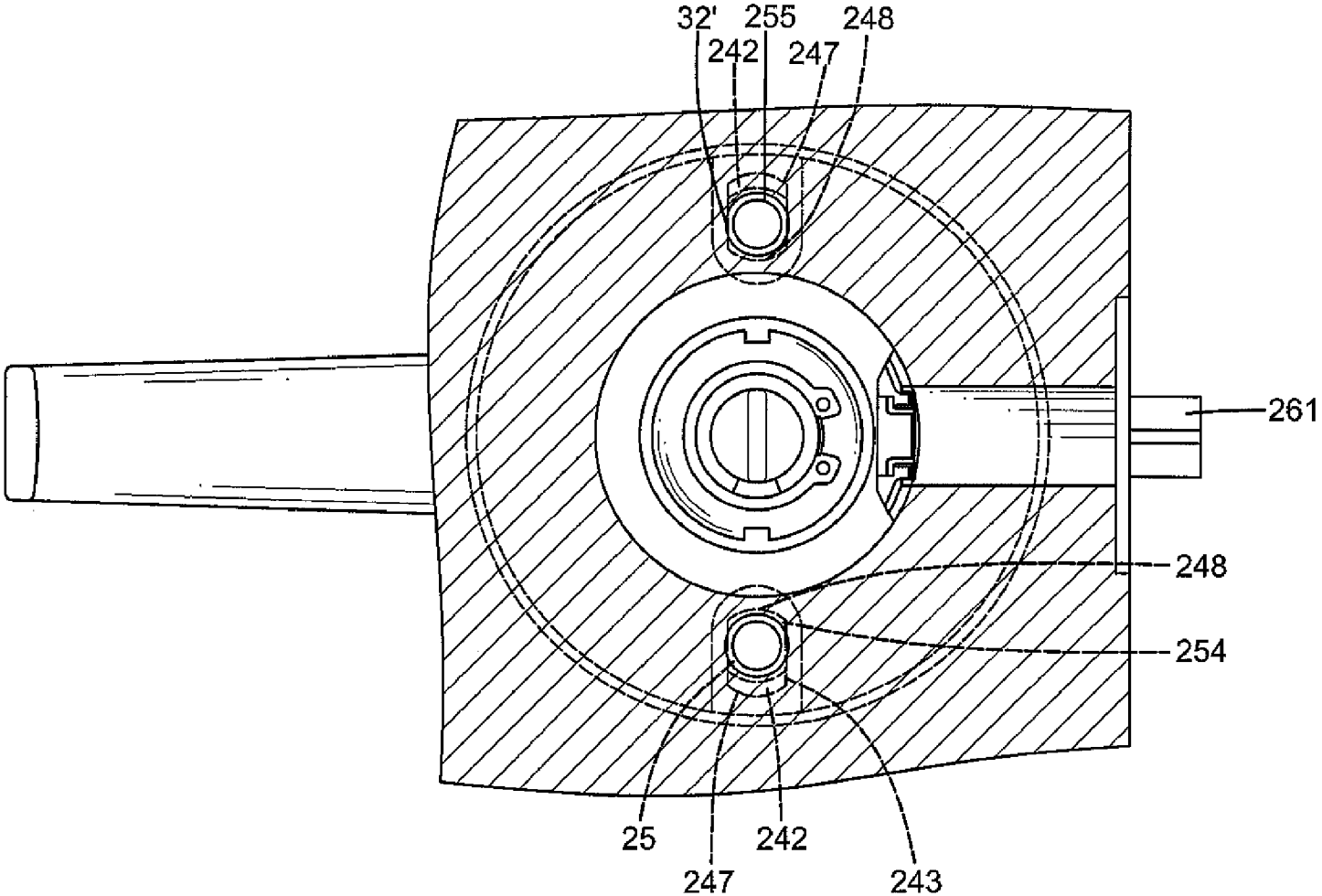
FIG. 7 shows a cross sectional view of the door and the door lock of FIG. 2 according to section line 6-6 of FIG. 2 with the two mounting posts having a smaller spacing therebetween.

In a case that the door lock 2 according to the preferred teachings of the present invention is to be mounted to a door 3 having two through-holes 32' (see FIGS. 3 and 4) with a shorter spacing therebetween, the mounting posts 25 can be moved radially inward to the inner ends 248 of the slots 242 of the outer mounting plate 24 corresponding to the distance between the through-holes 32' (FIG. 7). The subsequent procedures are identical to those for the door 3 with the through-holes 32 mentioned above. Thus, the door lock 2 according to the preferred teachings of the present invention allows easy, convenient installation. If the spacing between the through-holes 32 or 32' is not precise due to imprecise drilling, the mounting posts 25 can be adjusted to compensate the impression while the slots 242 of the outer mounting plate 24 and the holes 232 of the inner mounting plate 23 have a length in the radial direction greater than a diameter of the through-holes 32 or 32' of the door 3 to allow such adjustment. Conventional enlargement of the through-holes 32, 32' by a file or the like is not required.

The four pairs of the holes 232 of the inner mounting plate 23 allow the inner mounting plate 23 to be turned through a smaller angle to make one of the four pairs 232 of the inner mounting plate 23 align with the screw holes 252 of the mounting posts 25. Namely, the longitudinal position of the inner mounting plate 23 relative to the inner coupling seat 211 is changed to a small extent in response to the adjustment of the spacing between the mounting posts 25. This assures abutment of the inner mounting plate 23 with the inner side of the door 3 even after the adjustment of the spacing between the mounting posts 25.

Now that the basic teachings of the present invention have been explained, many extensions and variations will be obvious to one having ordinary skill in the art. For example, the inner and outer mounting plates 23 and 24 can be utilized with door locks of other types. The door lock 2 according to the preferred teachings of the present invention can be assembled in any suitable way. More or fewer pairs of holes 232 can be formed in the inner mounting plate 23. The inner flange 255 on each mounting post 25 can be omitted whenever necessary to save the punching procedure. The slots 242 of the outer mounting plate 24, the through-holes 291 of the washers 29, and the coupling sections 254 of the mounting posts 25 can have other cross sectional shapes. Furthermore, the lengths of the slots 242 of the outer mounting plates 24, the through-holes 291 of the washers 29, and the holes 232 of the inner mounting plate 23 can be varied. Furthermore, adjustment of the spacing between the mounting posts 25 can be achieved by moving only one of the mounting posts 25 when the amount of adjustment is small. Furthermore, one of the mounting posts 25 can be fixed and, thus, not adjustable relative to the outer mounting plate 24 according to needs. Further, the diameter of the holes 232 of the inner mounting plate 23 in the radial direction can be equal to the diameter of the through-holes 32 or 32' of the door 3.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A door lock comprising, in combination:

a casing adapted to be mounted in a bore extending from an inner side through an outer side of a door, with the casing including an outer coupling seat and an inner coupling seat coupled with the outer coupling seat;

an outer mounting plate mounted on the outer coupling seat and adapted to abut with the outer side of the door, with the outer coupling plate including two diametrically opposed slots adapted to be located outside the bore of the door;

first and second mounting posts extending through the two slots and adapted to extend through two through-holes in the door, with the first mounting post including a first coupling section slideably received in one of the two slots of the outer mounting plate, allowing the first mounting post to move in a radial direction toward or away from the second mounting post until a spacing between the first and second mounting posts is equal to that between the two through-holes of the door, with each of the first and second mounting posts including an inner end having a screw hole, with the second mounting post including a second coupling section slideably received in another of the two slots of the outer mounting plate, allowing the second mounting post to move in the radial direction relative to the outer mounting plate toward or away from the first mounting post;

an inner mounting plate mounted to the inner coupling seat and adapted to abut with the inner side of the door, with the inner mounting plate including a plurality of pairs of diametrically opposed holes, with the inner mounting plate being rotatable relative to the inner coupling seat to a position in which one of the plurality of pairs of holes is aligned with the two slots;

two screws extending through one of the plurality of pairs of holes aligned with the screw holes and into the screw holes of the first and second mounting posts;

a latch;

a retractor operably connected to the latch;

a spindle extending through the inner and outer coupling seats and the inner and outer mounting plates, with the spindle operably connected to the retractor and having inner and outer ends; and inner and outer handles coupled with the inner and outer ends of the spindle, so that rotation of either of the inner and outer handles causes rotation of the spindle to move the retractor for retracting the latch;

with the first mounting post including an outer end having the first coupling section, with the outer end of the first mounting post including a first outer flange having a diameter greater than a width of one of the two slots of the outer mounting plate in a direction perpendicular to the radial direction, with the first coupling section of the first mounting post provided with a first inner flange after insertion of the first mounting post through one of the two slots, with the first inner flange of the first coupling section having a diameter greater than the width of one of the two slots of the outer mounting plate, and with the first inner and outer flanges of the first mounting post being located on opposite sides of the outer mounting plate, preventing disengagement of the first mounting post, with the second mounting post including an outer end having the second coupling section, with the outer end of the second mounting post including a second outer flange having a diameter greater than a width of the other of the two slots of the outer mounting plate in a direction perpendicular to the radial direction, with the second coupling section of the second mounting post provided with a second inner flange after insertion of the second mounting post through the other of the two slots, with the second inner flange of the second coupling section having a diameter greater than the width of the other of the two slots of the outer mounting plate, and with the second inner and outer flanges of the second mounting post being located on opposite sides of the outer mounting plate, preventing disengagement of the second mounting post.

2. The door lock as claimed in claim 1, with each of the two slots having a length in the radial direction greater than a diameter of each of the through-holes of the door.

3. The door lock as claimed in claim 2, with each of the plurality of pairs of holes of the inner mounting plate having a length in the radial direction greater than the diameter of each of the two through-holes of the door.

4. The door lock as claimed in claim 3, with one of the two slots of the outer mounting plate including an inner end, an outer end more distant to the outer coupling seat than the inner end in the radial direction, and two parallel, rectilinear sides extending between the inner end and the outer end, with the first coupling section of the first mounting post including two lateral sides slideably abutting the two parallel, rectilinear sides of one of the two slots of the outer mounting plate, allowing movement of the first mounting post in the radial direction relative to the outer mounting plate and preventing rotational movement of the first mounting post relative to the outer mounting plate.

5. The door lock as claimed in claim 1, with the door lock further comprising, in combination: a resilient washer mounted between and frictionally abutting with the first outer flange of the first mounting post and an outer side of the outer mounting plate, preventing the first mounting post from moving in the radial direction but allowing forcible movement of the first mounting post in the radial direction.

6. The door lock as claimed in claim 5, with the resilient washer including a through-hole through which the first mounting post extends, and with the through-hole of the resilient washer having a length in the radial direction substantially the same as that of one of the two slots of the outer mounting plate.

7. The door lock as claimed in claim 1, with the outer mounting plate further including a first recessed portion formed on an inner side thereof and having a bottom wall, with one of the two slots of the outer mounting plate extending through the bottom wall of the first recessed portion, and with the first inner flange of the first mounting post being received in the first recessed portion of the outer mounting plate.

8. The door lock as claimed in claim 7, with the other of the two slots of the outer mounting plate including an inner end, an outer end more distant to the outer coupling seat than the inner end in the radial direction, and two parallel, rectilinear sides extending between the inner end and the outer end of the other of the two slots, with the second coupling section of the second mounting post including two lateral sides slideably abutting the two parallel, rectilinear sides of the other of the two slots of the outer mounting plate, allowing movement of the second mounting post in the radial direction relative to the outer mounting plate and preventing rotational movement of the second mounting post relative to the outer mounting plate.

9. The door lock as claimed in claim 8, with the door lock further comprising, in combination: a resilient washer mounted between and frictionally abutting with the second outer flange of the second mounting post and an outer side of the outer mounting plate, preventing the second mounting post from moving in the radial direction but allowing forcible movement of the second mounting post in the radial direction.

10. The door lock as claimed in claim 9, with the resilient washer including a through-hole through which the second mounting post extends, and with the through-hole of the resilient washer having a length in the radial direction substantially the same as that of the other of the two slots of the outer mounting plate.

11. The door lock as claimed in claim 7, with the outer mounting plate further including a second recessed portion formed on the inner side thereof and having a bottom wall, with the other of the two slots of the outer mounting plate extending through the bottom wall of the second recessed portion, and with the second inner flange of the second mounting post being received in the second recessed portion of the outer mounting plate.

* * * * *